United States Patent [19]

Inge et al.

[11] Patent Number: 4,721,505

[45] Date of Patent: Jan. 26, 1988

[54] CENTRIFUGAL SEPARATOR

[75] Inventors: Claes Inge, Saltsjoe-Duvnåes; Torgny Lagerstedt, Stockholm; Leonard Borgstroem, Bandhagen; Claes-Goeran Carlsson, Tullinge; Sven-Olof Naebo, Tyresoe; Hans Moberg, Stockholm; Peter Franzen, Tullinge, all of Sweden

[73] Assignee: Alfa-Laval Separation AB, Tumba, Sweden

[21] Appl. No.: 924,993

[22] Filed: Oct. 23, 1986

[30] Foreign Application Priority Data

Oct. 30, 1985 [SE] Sweden ..... 8505128

[51] Int. Cl.[4] ..... B04B 7/08

[52] U.S. Cl. ..... 494/74; 494/900

[58] Field of Search ..... 494/74, 75, 67, 27, 494/28, 85, 900; 210/360.1, 781

[56] References Cited

U.S. PATENT DOCUMENTS

| | | | |
|---|---|---|---|
| 2,126,864 | 8/1938 | Bath | 494/74 |
| 2,302,381 | 11/1942 | Scott | 494/65 |
| 3,967,777 | 7/1976 | Canevari | 494/74 |

*Primary Examiner*—Robert W. Jenkins

*Attorney, Agent, or Firm*—Davis Hozie Faithfull & Hapgood

[57] ABSTRACT

In a centrifuge having a rotor, an inlet structure has a stack of annular discs and a conduit supplying liquid to a receiving chamber formed centrally in the disc stack. The liquid mixture to be separated is caused to flow in thin layers in the passages between the discs, and by friction with the discs is accelerated to the rotational speed of the rotor. Liquid is supplied to the receiving chamber in such a way that a continuous liquid phase is maintained between the mixture in the supply conduit and in the receiving chamber.

14 Claims, 3 Drawing Figures

CENTRIFUGAL SEPARATOR

A problem long recognized in the continuous centrifugal separation of two or more components from a liquid mixture is how to accelerate the mixture to the rotational speed it will have in the separation chamber of the centrifuge rotor in a way which does not cause difficulties in the subsequent separation. The problem, more precisely, is to prevent the mixture under acceleration from being subjected to large shearing forces, for instance from turbulence, or to shock, since turbulence or shock may damage components of the mixture to an undesired degree.

Many different solutions of this problem have been suggested since the invention of centrifugal separators of the kind here in question. Thus it has been suggested, for instance, that the mixture should be given a certain rotational movement in a stationary supply device, before it is transferred to the rotor. Various designs have been proposed for members to be placed within the rotor for gradual acceleration of the incoming mixture on its way to the rotor separation chamber.

None of the solutions proposed so far has eliminated the problem, however, which thus still remains to a significant extent.

One solution suggested as long ago as 1940, but which does not seem to have got any wide practical application, is described in the Scott U.S. Pat. No. 2,302,381 . This patent shows a centrifugal separator comprising a rotor forming a separation chamber, and supply means with an opening centrally within the rotor for a liquid mixture of components to be separated, the rotor having an inlet device with several annular discs arranged coaxially with the rotor and with each other, said discs and the space they occupy forming a central receiving chamber for mixture entering the rotor through the supply means, the spaces between the discs constituting passages connecting the central receiving chamber with the rotor separating chamber.

In the Scott device there is a stationary supply pipe leading into the bottom of the rotor, which has a vertical axis of rotation. The supply pipe ends below the central receiving chamber and has an axially upwardly directed opening which is strongly throttled. Liquid mixture supplied through the supply pipe is formed into a jet by the throttled opening. This jet axially traverses the whole of the receiving chamber and hits a conical deflection member rotating with the rotor. The deflection member deflects the jet radially towards the annular discs and through the passages therebetween.

According to the Scott patent the inlet arrangement just described is said to cause the mixture supplied to be rapidly accelerated to the speed of the rotor without being subjected to violent shocks. The annular discs are said to bring the mixture to the same rotational speed as the rotor by friction, without the mixture having to impact any surface, for instance, on radially extending wings, with surfaces moving perpendicular to the direction of movement of the mixture.

As mentioned above, the inlet arrangement proposed by Scott has not found wide practical application, in spite of the advantageous effect of the annular discs.

The object of the present invention is to provide an inlet structure which comprises acceleration discs of the same general type as the inlet arrangement according to the Scott U.S. Pat. No. 2,302,381 but which is substantially improved with respect to the smoothness or gentleness of the handling of the mixtures supplied to the centrifuge rotor.

In accordance with the invention, this object is obtained by means of a structure in which there is a central receiving chamber formed by the annular discs which chamber communicates in a zone along its axial extension with a channel for leading away gas; a supply conduit having a discharge opening situated so that the inner openings of several of the passages between the discs are located axially between said discharge opening and said zone of the receiving chamber; means arranged during operation of the rotor to maintain at the discharge opening of the supply conduit a body of liquid extending through at least some of the passages between the discs; and in which the supply conduit is formed such that its discharge opening is situated within said liquid body during the operation of the rotor, so that liquid mixture supplied through the supply conduit forms a continuous liquid phase with said liquid body.

This invention is based on acceptance of the principle that annular discs arranged in a centrifuge rotor in the manner shown in Scott U.S. Pat. No. 2,302,381 have in fact a smooth and gentle effect on a mixture accelerated between the discs to the speed of the rotor. Further, however, the invention is also based on the realization that in an inlet arrangement according to the Scott U.S. Pat. No. 3,302,381 the supply of liquid to the central receiving chamber radially inside of the annular discs is not correspondingly smooth and gentle. On the contrary, strong throttling of the supply pipe opening and the impact of the jet formed thereby against the conical deflection member will cause strong turbulence and splitting of the components in the mixture. This undesired effect is of a magnitude such that the arrangement, seen as a whole, has not been more advantageous than other arrangements. The prerequisites for an overall improved separation result are not met because of the turbulent supply of mixture to the central receiving chamber. In an inlet arrangement according to the invention the discharge opening of the supply conduit for the feed mixture is, during the operation of the rotor, kept partly immersed in liquid already supplied to the rotor. This is a prerequisite for the entering mixture not to be split when it enters the rotor. It has been determined that relative movement between mixture thus already supplied and the supply conduit itself will not create any substantial shearing forces in the supplied mixture. In the invention, contact of the supplied mixture with air or other gases in the center of the rotor center is reduced to a minimum.

Primarily, the invention is intended to be used in cases where the supply member is stationary, i.e. not-rotatable. However, the invention is also applicable if the supply member for one reason or another is rotatable.

As in the known inlet arrangement according to Scott U.S. Pat. No. 2,302,381 the annular discs of the inlet device according to the invention preferably are entirely planar. However, other types, for instance frusto-conical discs, may be used. If the discs are frusto-conical, the passages therebetween may be used for preseparation of the component mixture under acceleration therein.

The invention may be used irrespective of the orientation of the centrifuge rotor axis and irrespective of the direction in which mixture is supplied into the rotor. Primarily, however, the invention is intended for a centrifuge rotor which has a vertical rotational axis and a supply member extending from above down into the rotor. According to a preferred embodiment of the invention, the central receiving chamber communicates at its upper part with a channel for removing gas, the supply conduit extending through and having its discharge opening situated below this part of the receiving chamber.

Preferably, the supply conduit extends through the whole of the receiving chamber, so that its opening is situated at the bottom of or below the receiving chamber. By this means the opening of the supply member may be kept immersed in liquid even if the influent flow of liquid to the rotor is very small. With a relatively small flow of mixture through the supply conduit only the passages between the discs which are situated closest to the supply conduit opening will in fact be traversed by liquid. Some of the remainder will be only partly filled with mixture and those closest to the receiving chamber will be gas filled, as will the zone of the receiving chamber communicating with the gas venting channel. With a relatively large flow of mixture substantially more of the passages and a larger part of the receiving chamber will be filled by liquid and, thus, the pumping effect of the discs will be correspondingly larger.

A corresponding change of the pumping effect of the inlet device is obtained upon variations of the counter pressure met by the flow of mixture after it has passed through the inlet device.

During normal operation of the centrifuge rotor there is thus preferably maintained a free liquid surface within the receiving chamber radially inside the annular acceleration discs.

The invention will be described below with reference to the accompanying drawing in which.

Figure 1:
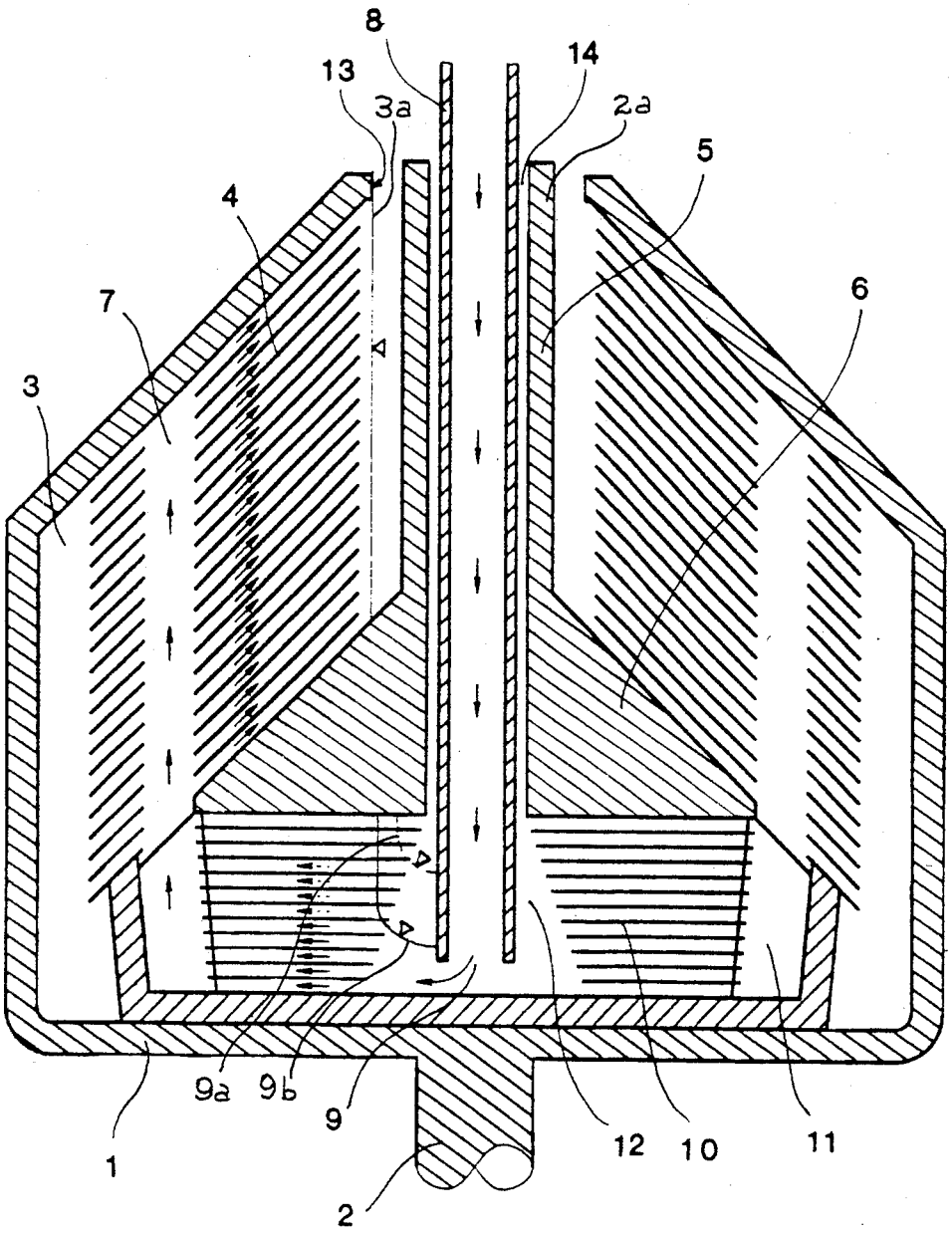
FIG. 1 is a schematic view in vertical section of a preferred embodiment of a centrifuge according to the invention.

In FIG. 1 there is shown schematically a centrifuge rotor in vertical section. A rotor body 1 is mounted on the upper end of a vertical drive shaft 2. Within the rotor body there is formed a separation chamber 3 containing a conventional set of frusto-conical separation discs 4.

A central member 2*a* within the rotor has a tubular upper part 5 and a frusto-conical lower part 6. Between the lower part 6 and the upper end wall of the rotor body 1 the separation discs 4 are positioned in the separation chamber 3. The said end wall may be formed separate from the rest of the rotor body and attached thereto axially by threads or the like. This construction is not shown. Through the set of separation discs 4 there extend several channels 7 formed by aligned holes in the separation discs.

A stationary supply pipe 8 extends downwardly centrally into the rotor body 1 supplying the mixture of components to be separated. The pipe 8 extends axially through the central member 2*a* in the rotor. It has a discharge opening 9 in the lower part of the rotor body interior.

Below the frusto-conical lower part of the central member 2*a* there is a stack of coaxially arranged planar annular discs 10. These discs are supported and kept axially spaced from each other by radially and axially extending wings 11 placed substantially radially outside the discs 10 and distributed around the rotor axis. Apart from wings 11, there are no spacing means between the discs 10 so that the passages therebetween are substantially annular.

In the center of the stack of discs 10 there is formed a receiving chamber 12 in which the opening 9 of the supply pipe 8 is situated. The space around the discs 10, which is divided into separate compartments by the wings 11, communicates at its upper side directly with the separation chamber 3, axially opposite to the channels 7 through the set of separating discs 4.

The upper end wall of the rotor has a radial inner free edge 13, which serves as an overflow outlet from the separation chamber 3 during operation of the rotor. An annular channel 14 provides a means through which the upper zone of the central receiving chamber 12 communicates with the atmosphere surrounding the rotor body.

The device shown in FIG. 1 operates in the following way:

While the rotor (including all the members shown in FIG. 1 except the supply pipe 8) is rotating, a liquid mixture of the components to be separated is supplied through the conduit 8. In the receiving chamber 12 and in the uppermost passages between the discs 10 there is formed a free liquid surface of a coherent liquid body extending from the interior of the pipe 8 out into the receiving chamber 12 and further through the passages between the lowermost discs 10. During the operation of the rotor the pipe 8 is thus partly submerged in liquid already present in the rotor.

The mixture entering the receiving chamber 12 flows in very thin layers through a larger or smaller number of passages between the discs 10. In these passages the mixture is brought substantially to the same rotational speed as the rotor by the friction between the discs and mixture. When the mixture reaches the wings 11, it has substantially the same speed as they have and is conducted by the winqs axially upwardly into the separation chamber 3. The space around the discs 10 thus communicates with the separation chamber 3 in the area of the uppermost discs 10, whereas the opening 9 of the inlet pipe 8 is situated in the area of the lowermost discs 10. This ensures a continuous throughflow of the whole space around the discs 10 even if all of the disc interspaces are not traversed by the incoming mixture.

In the separation chamber 3 the relatively heavy component of the mixture is separated from the relatively light component. It is presumed for continuous operation of the rotor that the relatively light component is in liquid form, so that it can flow radially inwards through the passages between the separation discs 4.

The relatively heavy component may be in liquid or solid form. Separated heavy component is collected in the radially outermost part of the separation chamber.

The inner free edge 13 of the upper end wall of the rotor forms an overflow outlet from the separation chamber 3 for the separated light liquid component. The edge 13 thereby simultaneously constitutes one of the means necessary to maintain at a certain level flow of liquid into the rotor above said free liquid surface in the receiving chamber 12, such that the supply pipe 8 will remain partly immersed in liquid. In FIG. 1 there is shown at 3*a* the free liquid surface formed in the separation chamber 3 during operation, and at 9*b* the free liquid surface formed in the receiving chamber 12 at a certain supply flow of mixture.

If the flow of mixture through the pipe 8 increases, the free liquid surface in the partly liquid filled passages between the discs 10 will move radially inwards. Simultaneously the liquid level rises along the outside of the pipe 8 in the central part of the receiving chamber 12 to a position shown in FIG. 1 at 9*a*. As can be seen, a larger total surface of the discs 10 then will have contact with the supplied mixture. Consequently, the pumping effect of the discs on the supplied mixture will increase. The pumping effect of the inlet device will thus increase with an increasing flow of supplied mixture.

Correspondingly, the pumping effect of the discs will decrease with a decreasing supply of mixture, since then the free liquid surface will move radially outwards and downwards. As can be seen from FIG. 1, the hole diameter of the discs 10 decreases axially upwardly. This means that every new disc, which as a consequence of an increased supply flow of liquid will be used for pumping, has a somewhat larger pumping effect than the underlying adjacent disc. This result is also contributed to by the fact that, as can be seen from FIG. 1, the discs 10 have an increasing outer diameter in the axially upward direction.

Air or other gases separated in the receiving chamber 12 from the supplied mixture pass upwardly through the annular channel 14.

Figure 2:
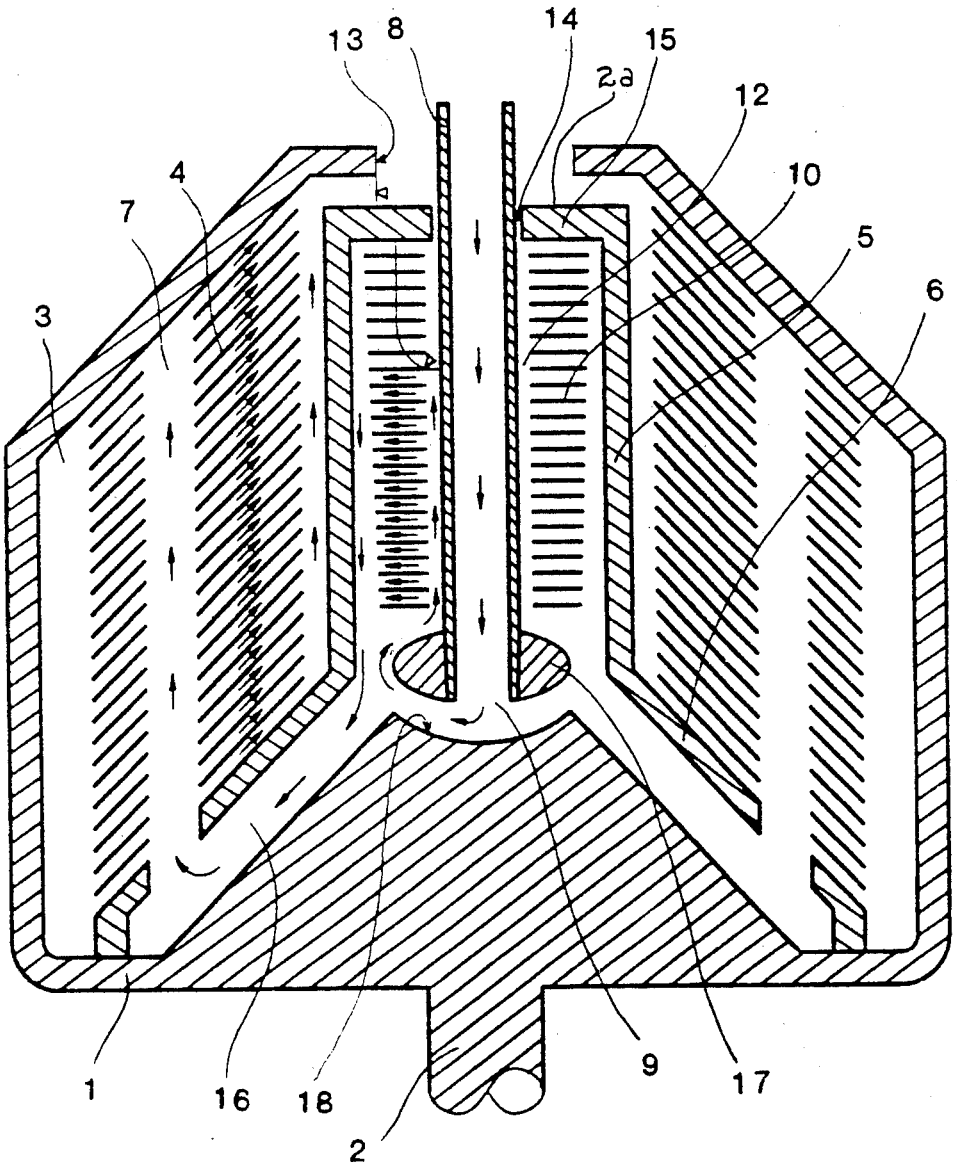
FIG. 2 is a schematic view in vertical section of a alternative embodiment of a centrifuge according to the invention; and, FIG. 3 is a schematic view of a supply pipe and distribution discs in a third embodiment of a centrifuge according to the invention.

In FIG. 2 there is shown an alternative embodiment of the invention. The parts thereof having counterparts in the embodiment according to FIG. 1 have been given the same reference numerals as in FIG. 1. Wings corresponding to the wings 11 in FIG. 1 have not been shown in FIG. 2, however, for the sake of clarity.

In FIG. 2 the tubular central member 2*a*, arranged centrally within the rotor has been provided at the end of its upper tubular part 5 with an internal annular flange 15. The acceleration discs 10 in this case are arranged axially between this flange 15 and the frustoconical lower part 6 of the central member 2*a*. The space radially outside of the discs 10 communicates at its lower end with the rotor separation chamber 3 through channels 16 formed between radial wings (not shown) evenly distributed around the rotor axis.

The opening 9 of the supply conduit 8 in FIG. 2 is situated a distance axially below the discs 10. Between the opening 9 and the lowermost disc 10 the conduit 8 supports an external annular flange 17. The flange 17 has the form of a lens with an elliptical axial section and is releasably mounted on the pipe 8. The lowermost portion of the pipe 8 is externally slightly conical—as is the inner surface of the annular flange 17. Upon removal of the pipe 8 from the rotor, the flange 17 will remain therein, the flange then being brought to rest centrally on a bowl shaped seating surface 18 in the rotor. After reinsertion of the pipe 8 in the rotor and supply of liquid through the pipe, the liquid will flow through the central hole in the flange below the flange and radially outwards between the flange and the concave surface 18. The flange will thus be pressed axially upwardly to the position which it has in FIG. 2. The convex under side of the flange 17 guarantees that no gas or air will collect below the flange.

After the incoming component mixture has flowed through the space between the flange 17 and the surface 18 it will turn axially upwardly, passing the edge of the flange 17 and flowing into the receiving chamber 12. Depending upon the magnitude of the incoming stream a larger or smaller number of passages between the discs 5 will be traversed by mixture, which after that will flow further on axially downwardly and through the channels 16 into the separation chamber 3. In the rest of the passages between the discs 10 a free liquid surface will be formed, as illustrated in FIG. 2. The discs 10 in FIG. 2, like the discs 10 in FIG. 1, have an outer diameter which increases upwardly.

The reason why the incoming mixture flows axially upwards towards the receiving chamber 12, instead of joining the axially downwards directed flow towards the channels 16, is that the latter flow is rotating substantially with the same speed as the rotor, whereas the incoming mixture below the flange 17 has not yet achieved any substantial rotational speed.

The object of arranging a flange 17 on the supply pipe 8 is primarily to accommodate a very small flow of mixture through the pipe 8 while maintaining a continuous liquid phase between mixture present within the pipe and mixture present outside the pipe within the rotor. A secondary object of the flange 17 is to prevent the incoming mixture being split by splashing up into the receiving chamber 12.

The discs 10 in FIG. 2, instead of being supported by means of wings similar to the wings 11 in FIG. 1, may be suspended from the flange 15. Thus, a number of rods (not shown) may be connected with the flange 15 and extend axially downwards through the stack of discs 10. Rods of this kind, which preferably extend through the radially outermost parts of the discs, may support spacing members between the discs for keeping the discs at a desired distance from each other.

Figure 3:
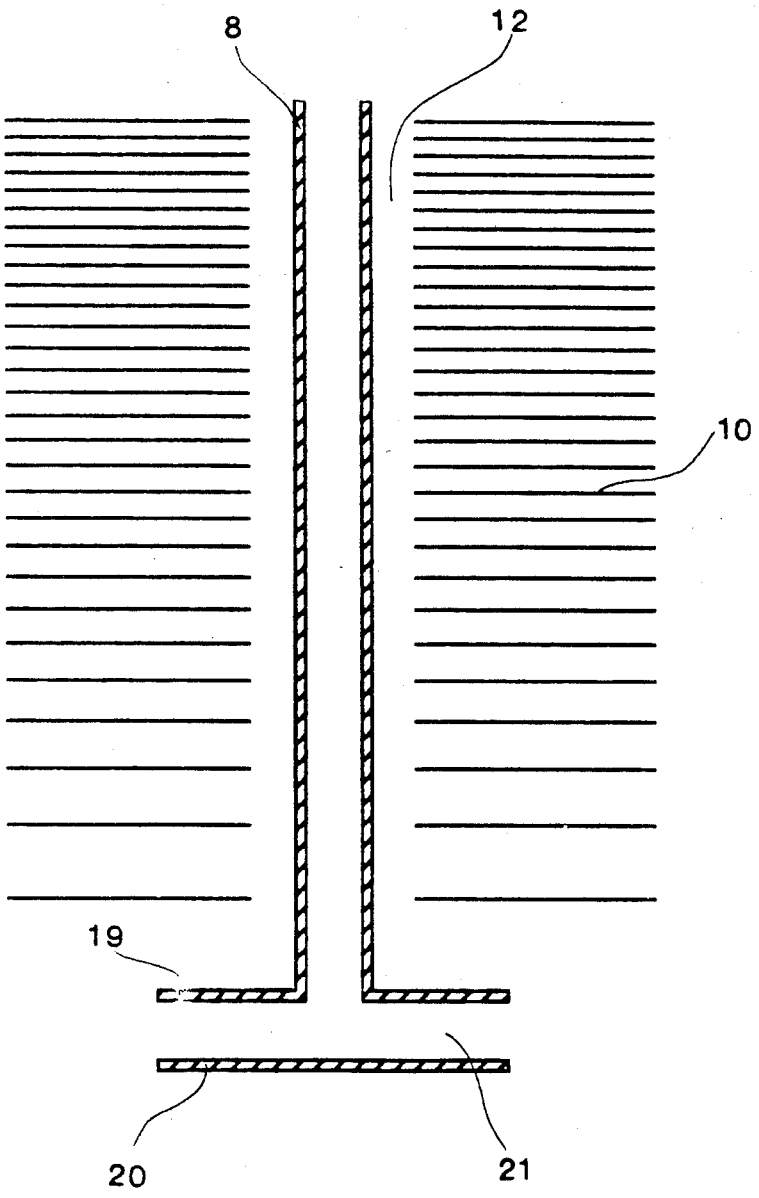

In FIG. 3 there is shown schematically a stack of annular discs 10 surrounding a stationary supply pipe 8. At its lower end the pipe 8 is provided with circular members 19 and 20 forming, together with wings or the like (not shown), radially directed channels 21 forming a continuation of the channel through the pipe 8. In this case the stationary supply pipe 8, 19, 20 thus has radially directed openings. If desired, the channels 21 may be replaced by a single substantially annular channel.

As can be seen from FIG. 3 the distances between the discs 10 gradually decrease in a direction from the supply member opening upwardly. This means that the lower part of the disc stack has a smaller pumping effect than the upper part of the disc stack, which is desirable so that a continuous liquid phase may be maintained from the interior of the supply member 8, 9, 20 to the separation chamber 3 even at a very small flow of mixture through the supply member.

The variation of the disc interspace width has the same effect as the variation of hole size and outer diameter of the discs 10 shown in FIG. 1.

The member 19 in FIG. 3 has substantially the same function as the flange 17 in FIG. 2.

The above mentioned pumping effect of the discs 10 is substantially obtained as a consequence of so called Ekman layers, formed closest to the surfaces of the discs 10. The thickness of these Ekman layers depends among other things upon the viscosity of the liquid in question. Typical Ekman layer thicknesses for liquids which may be processed in centrifugal separators of this kind are between 30$\mu$ and 35$\mu$. The smallest distance which should be present between adjacent discs for obtaining the desired smooth acceleration of liquid between the discs is twice the relevant Ekman layer thickness.

However, often solids present in the liquid supplied to a centrifugal separator will set a lower limit on the space between adjacent discs. This limit often is substantially above twice the relevant Ekman layer thickness. In practice the space between adjacent discs would seldom be smaller than 300μ. It is assumed that a common distance between the discs will be between 0.3 mm and 5.0 mm.

The pumping effect of the discs 10 may be amplified where desired, for instance, by means of radial ribs bridging the whole or a part of the distance between adjacent discs.

In the embodiments of the invention according to FIG. 1 and FIG. 2 the channel 14 communicates with the atmosphere surrounding the rotor. This is not always necessary. The reason for the channel 14 primarily is to enable at least a certain displacement of air or other gases out of the central receiving chamber 12, so that a significant number of acceleration discs 10 are not made ineffective as a consequence of gases being trapped in the receiving chamber, thus preventing inflow of mixture into the passages between said discs.

What we claim is:

1. In a centrifugal separator having a rotor, a separation chamber in said rotor, a conduit having a discharge opening within the rotor for supplying liquid mixture to be separated, a plurality of annular discs arranged coaxially with the rotor and spaced from one another, a central receiving chamber formed by said discs in the rotor for receiving liquid from said conduit, the spaces between said discs forming passageways connecting said receiving chamber with said separating chamber, the improvement which comprises a channel communicating with the receiving chamber in a zone along its axial extension for removing gas therefrom in an axial direction, the discharge opening of said supply conduit being positioned so that a plurality of said passages lie between said discharge opening and said zone, said supply conduit and said discs being arranged to maintain at the discharge opening a body of liquid extending through at least certain of said passages, the supply conduit being of a length such that its discharge opening is positioned within the body of liquid during operation of the rotor, whereby liquid mixture supplied through said conduit forms a liquid phase continuous with said liquid body.

2. A centrifugal separator as claimed in claim 1 wherein the parts of said separator are proportioned to maintain a free liquid surface in the central receiving chamber.

3. A centrifugal separator as claimed in claim 1 wherein the rotor has a vertical axis of rotation and the supply conduit extends vertically downwardly into the rotor and wherein the central receiving chamber communicates with the channel for removing gas at its upper part, the supply conduit extending through and having its discharge opening situated below this part of the receiving chamber.

4. A centrifugal separator as claimed in claim 1 wherein the supply conduit extends through the whole of the receiving chamber and has its opening 9 situated axially outside said chamber.

5. A centrifugal separator as claimed in claim 1 wherein the annular discs 10 have a decreasing hole diameter in the direction from the supply conduit discharge opening towards the connection between the receiving chamber and the gas removal channel.

6. A centrifugal separator as claimed in claim 1 wherein the annular discs have an increasing outer diameter in the direction from the supply conduit discharge opening towards the connection between the receiving chamber and the gas removal channel.

7. A centrifugal separator as claimed in claim 1 wherein the axial distance between adjacent annular discs is larger near the supply conduit discharge opening than it is near the connection between the receiving chamber and the gas removal channel.

8. A centrifugal separator as claimed in claim 1 wherein the supply conduit discharge opening 9 is directed axially within the rotor.

9. A centrifugal separator as claimed in claim 1 and comprising and external annular flange axially positioned between the supply conduit discharge opening and at least some of the annular discs.

10. A centrifugal separator as claimed in claim 9 wherein said flange has an outer diameter which is larger than the hole diameter of at least some of the annular discs.

11. A centrifugal separator as claimed in claims 9 or 10 in which the supply conduit discharge opening is directed axially in the rotor and the annular flange is convex on the side facing in the same axial direction as the supply conduit discharge opening.

12. A centrifugal separator as claimed in claim 9 wherein the annular flange is formed by a loose ring which is axially movable in relation to the supply conduit so that the supply conduit is retractable out of the rotor without having the ring accompany it, and comprising a seating member for retaining the ring in a position in the rotor with the supply conduit retracted such that upon reinsertion of the supply conduit into the rotor and subsequent supply of liquid thereto, liquid flows through the center hole of the ring and between the ring and the seating member to move the ring axially on the supply member.

13. Centrifugal separator as claimed in claim 12 wherein the supply conduit and the loose ring are shaped to limit the axial movement of the ring along the supply conduit.

14. Centrifugal separator as claimed in claim 1 wherein the discs are formed in a stack and the discharge opening of the supply conduit is situated at one axial end of the disc stack, there being a space surrounding the disc stack communicating with the separation chamber at the other end of the disc stack.

* * * * *